US011105047B2

(12) United States Patent
Springer

(10) Patent No.: US 11,105,047 B2
(45) Date of Patent: Aug. 31, 2021

(54) TAMPING UNIT AND METHOD FOR TAMPING SLEEPERS OF A TRACK

(71) Applicant: PLASSER & THEURER EXPORT VON BAHNBAUMASCHINEN GESELLSCHAFT M.B.H., Vienna (AT)

(72) Inventor: Heinz Springer, Tokyo (JP)

(73) Assignee: PLASSER & THEURER EXPORT VON BAHNBAUMASCHINEN GESELLSCHAFT M.B.H., Vienna (AT)

( * ) Notice: Subject to any disclaimer, the term of this patent is extended or adjusted under 35 U.S.C. 154(b) by 339 days.

(21) Appl. No.: 16/330,133

(22) PCT Filed: Sep. 7, 2017

(86) PCT No.: PCT/EP2017/001056
§ 371 (c)(1),
(2) Date: Mar. 4, 2019

(87) PCT Pub. No.: WO2018/065080
PCT Pub. Date: Apr. 12, 2018

(65) Prior Publication Data

US 2019/0234025 A1 Aug. 1, 2019

(30) Foreign Application Priority Data

Oct. 4, 2016 (AT) ..... A 457/2016

(51) Int. Cl.
*E01B 27/16* (2006.01)

(52) U.S. Cl.
CPC ..... *E01B 27/16* (2013.01)

(58) Field of Classification Search
CPC ..... E01B 2/16; E01B 2/17; E01B 2203/12; E01B 2203/122; E01B 2203/125; E01B 2203/127
See application file for complete search history.

(56) References Cited

U.S. PATENT DOCUMENTS 3,608,496 A * 9/1971 Schenkir ..... E01B 27/13 104/12
5,533,455 A * 7/1996 Theurer ..... E01B 27/16 62/298

(Continued)

FOREIGN PATENT DOCUMENTS

AT 500 972 B1 5/2006
AT 513 277 B1 3/2014

(Continued)

OTHER PUBLICATIONS

International Search Report in PCT/EP2017/001056, dated Nov. 16, 2017.

(Continued)

*Primary Examiner* — Jason C Smith
(74) *Attorney, Agent, or Firm* — Collard & Roe, P.C.

(57) ABSTRACT

The invention relates to a tamping unit (1) for tamping sleepers (2) of a track (3), having a tool carrier (6) mounted on an assembly frame (12) for vertical adjustment by means of a drive (10), having pairs of two oppositely positioned tamping tools (5) which are squeezable towards one another about a respective pivot axis (4) as well as designed to be set in vibrations by a vibration drive (8). In this, it is provided that a vibration drive (11) is associated with the drive (10), the vibration drive setting the tamping tools in a vibration which is effective vertically.

5 Claims, 1 Drawing Sheet

(56) References Cited

U.S. PATENT DOCUMENTS

| | | | | |
|---|---|---|---|---|
| 9,546,453 | B2 * | 1/2017 | Springer | E01B 27/16 |
| 9,957,668 | B2 * | 5/2018 | Lichtberger | E01B 27/16 |
| 10,829,897 | B2 * | 11/2020 | Springer | E01B 27/20 |
| 2006/0090666 | A1 * | 5/2006 | Theurer | E01B 27/16 104/12 |
| 2015/0233062 | A1 * | 8/2015 | Springer | E01B 27/16 104/12 |
| 2015/0267355 | A1 * | 9/2015 | Hofstaetter | E01B 27/16 104/10 |
| 2016/0010287 | A1 * | 1/2016 | Lichtberger | E01B 27/16 104/10 |
| 2019/0234025 | A1 * | 8/2019 | Springer | E01B 27/16 |
| 2019/0271120 | A1 * | 9/2019 | Springer | B06B 1/18 |

FOREIGN PATENT DOCUMENTS

| | | | |
|---|---|---|---|
| AT | 513 973 | B1 | 9/2014 |
| CH | 434 326 | A | 4/1967 |
| CN | 1125281 | A | 6/1996 |
| CN | 105189868 | A | 12/2015 |
| DE | 19 28 619 | A1 | 1/1970 |
| EP | 3 026 178 | A1 | 6/2016 |
| GB | 994 905 | A | 6/1965 |
| RU | 2 597 258 | C1 | 9/2016 |

OTHER PUBLICATIONS

English translation of Chinese Office Action issue for Chinese Application No. 201780061189.7, dated May 7, 2020.
Chinese Office Action in Chinese Application No. 201780061189.7, dated May 7, 2020.

* cited by examiner

TAMPING UNIT AND METHOD FOR TAMPING SLEEPERS OF A TRACK

CROSS REFERENCE TO RELATED APPLICATIONS

This application is the National Stage of PCT/EP2017/001056 filed on Sep. 7, 2017, which claims priority under 35 U.S.C. § 119 of Austrian Application No. A 457/2016 filed on Oct. 4, 2016, the disclosure of which is incorporated by reference. The international application under PCT article 21(2) was not published in English.

FIELD OF TECHNOLOGY

The invention relates to a tamping unit for tamping sleepers of a track, having a tool carrier mounted on an assembly frame for vertical adjustment by means of a drive, having pairs of two oppositely positioned tamping tools which are squeezable towards one another about a respective pivot axis as well as designed to be set in vibrations by a vibration drive. The invention additionally relates to a method for tamping sleepers of a track by means of the tamping unit.

PRIOR ART

Tamping units for tamping sleepers of a track are already well known, such as, for example from AT 500 972 B1 or AT 513 973 B1. Vibrations acting upon the tamping tines can be produced either mechanically by means of an eccentric shaft or by hydraulic impulses in a linear motor.

The tamping tools designed to be employed in the tamping units of track tamping machines are immersed into the ballast between the individual sleepers and are squeezed together in pairs under the sleepers to tamp the ballast. During this, great forces are transmitted to the tamping tools; in particular, when tamping a ballast bed which has not been renewed and is often totally encrusted, a high immersion resistance often has to be surmounted during penetration of the ballast bed, and occasionally damage to the tamping tools can occur.

As is known, optimal tamping frequencies for consolidation are between 25 to 40 Hz, wherein a penetration of the tamping tines into the ballast can be carried out easier at higher frequencies.

SUMMARY OF THE INVENTION

It is the object of the invention to provide an improvement over the prior art for a tamping unit and a method of the type mentioned at the beginning.

According to the invention, this object is achieved by way of a tamping unit according to claim 1 and a method according to claim 4. Advantageous further developments of the invention become apparent from the dependent claims.

The invention provides that a vibration drive is associated with the drive for lowering the tool carrier, the vibration drive setting the tamping tools in a vibration which is effective vertically. An essential advantage here lies in the fact that an easier penetration of the tamping tools into the ballast takes place. As a result of the vertical vibration, the immersion impact is weaker. This causes less wear at the tamping tools, the service intervals become longer, and the strain at the bearings of the tamping unit is reduced. The optimal frequency of the vertical vibration is around 35 Hz.

Advantageously, the drive and the associated vibration drive are designed as a common hydraulic cylinder in which a pressure chamber is actuated with a pulsing fluid stream. With this, the possibility is created to adapt existing tamping units. Specifically, an existing hydraulic cylinder for lowering or lifting the tool carrier is controlled in a pulsing manner during an immersion procedure.

In this, it is advantageous if a servo valve or proportional valve activated by means of a control is arranged at the hydraulic cylinder. Such valves are suitable for a pulsing control, wherein the mounting directly on the hydraulic cylinder precludes a damping effect of hydraulic lines.

It is also advantageous if the vertically effective vibration is switched on automatically during immersion and switched off automatically upon reaching a pre-set tamping depth or at the beginning of squeezing of the tamping tools. This results in an increase of efficiency of the tamping unit, wherein the squeezing motion of the tamping tools takes place in the proven manner.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
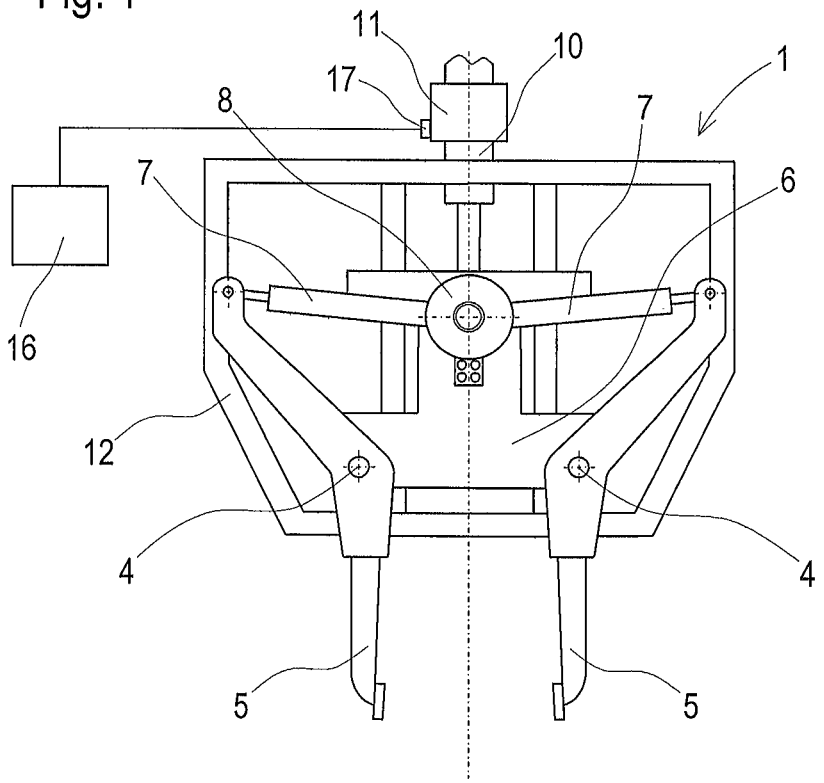
FIG. 1 a schematic side view of a tamping unit.

A tamping unit 1, shown in a simplified way in FIG. 1, for tamping sleepers 2 of a track 3 has pairs of two tamping tools 5 each, pivotable about a pivot axis 4, which are mounted on a tool carrier 6 and are each connected to a squeezing drive 7. Each squeezing drive 7 is connected to a vibration drive 8 designed as an eccentric. With this, horizontal vibration oscillations are produced which are transmitted via the squeezing drive 7 and the respective tamping tool 5 to the ballast 9 to be compacted. The tool carrier 6 is mounted on an assembly frame 12 for vertical adjustment by means of a drive 10 having an associated vibration drive 11. A servo valve 17 including a control 16 is associated with the drive 10.

Figure 2:
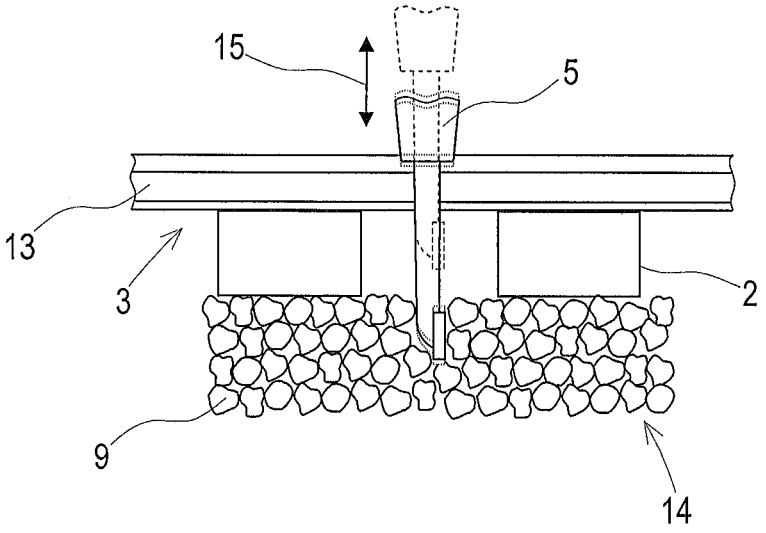
FIG. 2 a detail view of a tamping tool.

Shown in FIG. 2 is a track 3 with a ballast bed 14, the track comprising rails 13 and sleepers 2. The tamping tool 5 designed to be set in a vertical vibration by the vibration drive 11 (arrow 15) is moved during the immersion procedure by means of the drive 10 from a raised position (dashed line) into a lowered position (full line). The amplitude of the tamping tools set in vertical vibration is in the millimetre range (dotted line).

Advantageously, the drive 10 and the vibration drive 11 are united in a common hydraulic cylinder. In this, the hydraulic cylinder is activated during an immersion procedure with a pulsing fluid stream, as a result of which a vibration motion is superimposed on the lowering motion of the tool carrier 6.

The method and operating mode will be described as follows. For easier penetration of the tamping tools 5 into the ballast bed 14, the vibration drive 11 associated with the drive 10 is switched on, and the tamping tools 5 are additionally set in a vertical vibration. An automatic switching on of the vertical vibration takes place only in the phases of immersion of the tamping tools 5. An automatic switching off of the vertical vibration takes place upon reaching a pre-set tamping depth or at the start of squeezing.

The invention claimed is:

1. A tamping unit for tampingsleepers of a track, comprising:

an assembly frame;

a drive;

a tool carrier mounted on said assembly frame for vertical adjustment by means of said drive, pairs of two oppositely positioned tamping tools coupled to said drive wherein said tamping tools are squeezable towards one another about a respective pivot axis;

a vibration drive configured for vibrating said tamping tools and which is configured for producing horizontal vibrations;

a squeezing drive configured for squeezing said tamping tools together;

wherein said vibration drive is associated with the drive, the vibration drive setting the tamping tools in a vibration which is effective vertically.

2. The tamping unit accordingto claim 1, wherein the drive and the associated vibration drive are designed as a hydraulic cylinder in which a pressure chamber is actuated with a pulsing fluid stream.

3. The tamping unit accordingto claim 2, wherein a servo valve or proportional valve activated by means of a control is arranged at the hydraulic cylinder.

4. A method for tamping sleepers of a track by means of a tamping unit according to claim 1, wherein the tamping tools are set in a vertically effective vibration during immersioninto a ballast bed.

5. The method for tamping sleepers of a track according to claim 4, wherein the vertically effective vibration is switched on automatically during immersion and switched off automatically upon reaching a pre-set tamping depth or at the beginning of squeezing ofthe tamping tools.

* * * * *